United States Patent [19]

Pirklbauer

[11] Patent Number: 4,995,907

[45] Date of Patent: Feb. 26, 1991

[54] METHOD OF DEOXIDING AND ALLOYING STEEL

[75] Inventor: Wilfried Pirklbauer, Niederneukirchen, Austria

[73] Assignee: Voest-Alpine Industrieanlagenbau Gesellschaft m.b.H., Linz, Austria

[21] Appl. No.: 497,337

[22] Filed: Mar. 22, 1990

[30] Foreign Application Priority Data

Mar. 23, 1989 [AT] Austria ..... 687/89

[51] Int. Cl.[5] ..... C21C 7/02

[52] U.S. Cl. ..... 75/561; 75/560; 75/568

[58] Field of Search ..... 75/560, 561, 568

[56] References Cited

U.S. PATENT DOCUMENTS

| | | | |
|---|---|---|---|
| 1,017,807 | 2/1912 | Rossi | 75/561 |
| 2,705,196 | 3/1959 | Wever | 75/568 |
| 3,467,167 | 9/1969 | Mahin | 75/560 |
| 4,129,439 | 12/1978 | Nashiwa et al. | 75/58 |

*Primary Examiner*—Peter D. Rosenberg

*Attorney, Agent, or Firm*—Ostrolenk, Faber, Gerb & Soffen

[57] ABSTRACT

To produce deoxidized steel by the addition of deoxidizing agents to molten crude steel having an oxygen content of at least 200 ppm and the subsequent addition of alloying agents, the deoxidation is realized at least partially under the formation of liquid deoxidation products by the simultaneous addition of the two deoxidizing agents FeSi and FeMn. The method according to the invention ensures a great analytical precision of the steel and is not limited to the production of certain steels.

5 Claims, No Drawings

METHOD OF DEOXIDING AND ALLOYING STEEL

The invention relates to a method of deoxidizing and alloying steel by the addition of deoxidizing agents to molten crude steel having an oxygen content of at least 200 ppm and the subsequent addition of alloying agents.

A method of deoxidizing and alloying steel is known from German Auslegeschrift No. 25,23,095. According to there, an alloy comprised of 13 to 16 % Si, 55 to 63% Mn, 4 to 6% Al and Fe as well as unavoidable impurities is added to molten crude steel.

On account of this alloy being composed of three deoxidizing alloying elements, that method is limited to the production of steels in which a content of Si, Mn and Al as alloying elements is safe However, there exists the danger of overalloying, since all the three elements are introduced into the molten crude steel at defined ratios, although exhibiting different burn-up behaviours. Moreover, an undesiredly high inclusion of deoxidation products in the steel may result Nor does the method offer any opportunity of minimizing the costs for deoxidation.

The invention aims at avoiding these disadvantages and has as its object to provide a method of the initially defined kind which allows for greater analytical precision of the steel and is not limited to the production of certain steels.

In accordance with the invention, this object is achieved with a method of the initially defined kind in that the deoxidation is realized at least partially under the formation of liquid deoxidation products by the simultaneous addition of the two deoxidizing agents FeSi and FeMn.

It is known to the skilled artisan from the constitutional diagram of the deoxidation products MnO and $SiO_2$ that the melting point of the oxide mixture MnO—$SiO_2$ strongly varies with its composition, values of between 1200° C. and 1800° C. being attainable. Thus, the invention is based on the knowledge that only slight inclusions of deoxidation products will be contained in the finished steel if the two deoxidation products FeMn and FeSi are added simultaneously at a mutual ratio that yields liquid deoxidation products according to the constitutional diagram.

These liquid deoxidation products rise within the molten steel as a result of the lower density and are capable of being separated to the major extent. Thereby, a high analytical precision may be obtained.

The amount of liquid deoxidation products incurred, furthermore, involves a reduction of their chemical activity and, thus, a decrease in the oxygen equilibrium value such that the extent of a residual oxidation under the formation of solid deoxidation products in minimized, which further increases the analytical precision.

The small amounts of residual deoxidation products remaining at the solidification of steel, which originally incurred in a liquid state in the steel, solidify to spherical shapes, thus imparting favorable thermoforming properties to the finished steel.

Residual deoxidation may be carried out with Al. With a high oxygen content of the crude steel, a first deoxidation, preferably, occurs with C, whose gaseous deoxidation product naturally does not adversely affect the analytical precision of the steel and, moreover, carries ash slag upwardly when rising within the molten crude steel.

Preferably, C and/or Al are, therefore, added as additional deoxidation agents, C, if desired, being added before Al.

Thereby, the required amount of deoxidizing agents is restricted to the amount absolutely necessary, thus minimizing the costs for the deoxidation of crude steel.

The method according to the invention will be explained in more detail by way of the following exemplary embodiments. The molten crude steels used as starting materials had a temperature of 1,600° C. in all the examples. According to the constitutional diagram for the system MnO—$SiO_2$, there will be mixed oxides at 1,600° C. if their content of $SiO_2$ amounts to more than 20% by mass and less than 50% by mass. The calculation of the oxygen equilibrium activites within the steel at this temperature was based on the following constants for the solubility product (from Rev. Met., June 1979, p. 378):

| Reaction | Solubility Product |
|---|---|
| $C + O \rightleftarrows CO$ | $\lg[C][O] = -2.694$ |
| $Si + 2O \rightleftarrows SiO_2$ | $\lg[Si][O]^2 = -4.572$ |
| $2Al + 3O \rightleftarrows Al_2O_3$ | $\lg[Al]^2[O]^3 = -0.1298$ |
| $Mn + O \rightleftarrows MnO$ | $\lg[Mn][O] = -1.335$ |

EXAMPLE 1

Steel St 52.3 with the following target analysis was to be produced:

| Element: | C | Si | Mn | Al |
|---|---|---|---|---|
| Target analysis (% by weight): | 0.18 | 0.45 | 1.45 | 0.05 |

As the starting material, molten crude steel having a measured oxygen activity (Henry activity) of 300 ppm was used, containing the elements of the target analysis in the following concentrations:

| Element: | C | Si | Mn | Al |
|---|---|---|---|---|
| Concentrations (% by weight): | 0.09 | — | 0.30 | — |

By the aid of the above-mentioned constants for the solubility product and the concentrations desired for the target analysis, an equilibrium oxygen activity of 61 ppm is calculated at 1,600° C. by taking into account the limit values for the formation of liquid MnO—$SiO_2$ mixed oxide. The deoxidation to this value and the adjustment of the target analysis, in total, was effected by the addition of coking duff, FeSi, FeMn (80% Mn; 7% C.) and Al, the following amounts (kg) having been used per ton of crude steel:

| | |
|---|---|
| 1. FeSi and FeMn: | |
| FeSi for deoxidation | 0.181 |
| FeSi for alloying | 5.999 |
| FeMn for deoxidation | 0.348 |
| FeMn for alloying | 13.855 |
| 2. Al | |
| Al for deoxidation | 0.065 |
| Al for alloying | 0.500 |
| 3. Coking duff for alloying | 0.999 |

The deoxidation products per ton of steel were: 0.2906 kg $SiO_2$, 0.3728 kg MnO and 0.1229 kg $Al_2O_3$.

$SiO_2$ and MnO incurred in the liquid state (43.80 % $SiO_2$ in the $SiO_2$—MnO mixture) and $Al_2O_3$ incurred in the solid state.

The analysis of the alloyed steel exactly corresponded to the preset target analysis.

EXAMPLE 2

Tube steel with the following target analysis was to be produced:

| Element: | C | Si | Mn | Al |
|---|---|---|---|---|
| Target analysis (% by weight): | 0.10 | 0.40 | 1.60 | 0.04 |

As the starting material, molten crude steel having a measured oxygen activity (Henry activity) of 600 ppm was used, containing the elements of the target analysis in the following concentrations:

| Element: | C | Si | Mn | Al |
|---|---|---|---|---|
| Concentrations (% by weight): | 0.20 | — | 0.20 | — |

By the aid of the above-mentioned constants for the solubility product and the concentrations desired for the target analysis, an equilibrium oxygen activity of 62 ppm is calculated at 1,600° C. by taking into account the limit values for the formation of liquid MnO—$SiO_2$ mixed oxide. The deoxidation to this value and the adjustment of the target analysis, in total, was effected by the addition of coking duff, FeSi, FeMn (80% Mn; 7% C.) and Al, the following amounts (kg) having been used per ton of crude steel:

-continued

| | |
|---|---|
| 1. FeSi and FeMn: | |
| FeSi for deoxidation | 0.399 |
| FeSi for alloying | 5.333 |
| FeMn for deoxidation | 0.812 |
| FeMn for alloying | 16.867 |
| 2. Al | |
| Al for deoxidation | 0.065 |
| Al for alloying | 0.400 |
| 3. Coking duff for alloying | 0.889 |

The deoxidation products per ton of steel were: 0.6413 kg $SiO_2$, 0.8705 kg MnO and 0.1225 kg $Al_2O_3$.

$SiO_2$ MnO incurred in the liquid state (42.4% $SiO_2$ in the $SiO_2$—MnO mixture and $Al_2O_3$ incurred in the solid state.

The analysis of the alloyed steel exactly corresponded to the preset target analysis.

What is claimed is:

1. In a method of deoxidizing and alloying steel by preparing molten crude steel having an oxygen content of at least 200 ppm, adding deoxidizing agents to said molten crude steel, and subsequently adding alloying agents, the improvement wherein FeSi and FeMn are simultaneously added as said deoxidizing agents at a ratio that at least partially yields liquid deoxidation products during deoxidizing.

2. A method as set forth in claim 1, further comprising adding at least one of C and Al as additional deoxidizing agents.

3. A method as set forth in claim 2, wherein C is added before Al.

4. The method of claim 1, wherein the ratio based upon weight of FeSi to FeMn is between 1:1.923 to 1:2.236 per ton of crude steel.

5. The method of claim 1, wherein the liquid deoxidation products comprise SiOHd 2, MnO and $Al_2O_3$.

* * * * *